US010774565B2

(12) United States Patent
Colligan

(10) Patent No.: US 10,774,565 B2
(45) Date of Patent: Sep. 15, 2020

(54) PIVOTABLE BOLT

(71) Applicant: Accurate Lock & Hardware Co. LLC, Stamford, CT (US)

(72) Inventor: Francis Colligan, New Haven, CT (US)

(73) Assignee: Accurate Lock & Hardware Co. LLC, Stamford, CT (US)

( * ) Notice: Subject to any disclaimer, the term of this patent is extended or adjusted under 35 U.S.C. 154(b) by 1180 days.

(21) Appl. No.: 15/079,958

(22) Filed: Mar. 24, 2016

(65) Prior Publication Data

US 2017/0275919 A1 Sep. 28, 2017

(51) Int. Cl.

| | |
|---|---|
| ***E05B 17/20*** | (2006.01) |
| ***E05B 63/08*** | (2006.01) |
| ***E05B 59/00*** | (2006.01) |
| ***E05C 5/00*** | (2006.01) |

(52) U.S. Cl.

CPC ..... *E05B 17/2084* (2013.01); *E05B 59/00* (2013.01); *E05B 63/08* (2013.01); *E05C 5/00* (2013.01)

(58) Field of Classification Search

CPC ..... E05C 1/02; E05C 1/06; E05C 1/08; E05C 1/12; E05C 5/00; E05B 17/0054; E05B 17/2084; E05B 17/2088; E05B 59/00; E05B 63/08; E05B 63/127; Y10T 292/0887; Y10T 292/0964; Y10T 292/0967; Y10T 292/1016; Y10T 292/102; Y10T 292/0803; Y10T 292/0806; Y10T 292/0836; Y10T 292/0837; Y10T 292/0838; Y10T 292/084; Y10T 292/0877

USPC ..... 292/5, 7, 33, 34, 35, 37, 71, 64, 159, 292/161, 140, 143

See application file for complete search history.

(56) References Cited

U.S. PATENT DOCUMENTS

| | | | | | |
|---|---|---|---|---|---|
| 30,594 | A * | 11/1860 | Slaight | E05B 63/127 | 292/191 |
| 866,893 | A * | 9/1907 | Seyffarth | E05B 55/00 | 292/192 |
| 2,097,232 | A * | 10/1937 | Hartman | E05B 17/0025 | 292/192 |
| 2,107,299 | A * | 2/1938 | Kilpatrick | E05B 63/127 | 292/192 |
| 2,124,751 | A * | 7/1938 | Saxton | E05B 85/22 | 292/192 |
| 2,156,004 | A * | 4/1939 | Vanderlinde | E05B 85/24 | 292/192 |
| 2,350,306 | A * | 5/1944 | Spain | E05B 63/127 | 292/346 |
| 2,379,050 | A * | 6/1945 | Voight | E05B 63/127 | 292/110 |
| 2,631,051 | A * | 3/1953 | Lickteig, Jr. | E05B 63/04 | 292/244 |

(Continued)

FOREIGN PATENT DOCUMENTS

| | | | | |
|---|---|---|---|---|
| DE | 19654454 A1 | 12/1997 | | |
| FR | 2666370 A1 * | 3/1992 | | E05B 63/127 |

*Primary Examiner* — Christine M Mills

(74) *Attorney, Agent, or Firm* — Forge IP, PLLC

(57) ABSTRACT

A bolt assembly usable in a mortise lock. The assembly includes a bolt and tailpiece that are pivotable relative to one another. In one embodiment, the bolt and tailpiece are joined by a pin that permits the components to pivot relative to one another.

19 Claims, 6 Drawing Sheets

(56) References Cited

U.S. PATENT DOCUMENTS

| | | | | | |
|---|---|---|---|---|---|
| 2,696,398 | A * | 12/1954 | Teetor | E05B 57/00 | 292/192 |
| 2,726,890 | A * | 12/1955 | Teetor | E05C 3/162 | 292/192 |
| 2,753,201 | A * | 7/1956 | Teetor | E05C 3/162 | 292/64 |
| 2,848,886 | A * | 8/1958 | Albert | E05B 55/00 | 292/170 |
| 3,934,435 | A | 1/1976 | Gresham | | |
| 4,423,895 | A | 1/1984 | Mosley, Jr. | | |
| 4,520,639 | A | 6/1985 | Wartian | | |
| 4,832,388 | A | 5/1989 | Lozano | | |
| 4,899,562 | A | 2/1990 | Gartner et al. | | |
| 4,902,053 | A * | 2/1990 | Hakkarainen | E05B 47/0002 | 292/144 |
| 5,083,448 | A * | 1/1992 | Karkkainen | E05B 47/0012 | 292/144 |
| 5,113,676 | A * | 5/1992 | Panossian | E05B 55/12 | 292/18 |
| 5,758,527 | A | 6/1998 | Crepinsek | | |
| 6,299,222 | B1 * | 10/2001 | Atmodimedjo | E05B 15/102 | 292/144 |
| 7,007,524 | B2 | 3/2006 | Jasper | | |
| 7,007,526 | B2 | 3/2006 | Frolov et al. | | |
| 7,096,698 | B2 | 8/2006 | Walsh, III et al. | | |
| 7,836,737 | B2 | 11/2010 | Lin | | |
| 8,261,586 | B2 | 9/2012 | Gartner | | |
| 8,870,242 | B2 | 10/2014 | Quijano | | |
| 8,978,428 | B2 | 3/2015 | Trent et al. | | |
| 2016/0138309 | A1 * | 5/2016 | Wollacott | E05B 63/06 | 292/122 |

* cited by examiner

PIVOTABLE BOLT

FIELD OF THE INVENTION

The invention relates to lock assemblies. More specifically, the invention relates to a deadbolt and a latch for use in mortise lock assemblies.

BACKGROUND OF THE INVENTION

Mortise locks are well known devices used to latch swinging doors in a closed position. A typical mortise lock includes a lock body in which the moving components of the lock are disposed and a strike plate. The lock body is typically installed in a mortise (or pocket) that has been cut in the material of a door. The strike plate is typically installed on the doorframe in a position appropriate for it to interact with the lock body. The strike plate includes one or more openings for receiving one or more latches or deadbolts from the lock body. These latches and deadbolts serve various purposes but generally are intended to latch or lock the door in a closed position.

Mortise locks usually include a latch for securing a door in a closed position. The latch has an extended position in which the latch protrudes from the lock body and into an opening of the strike plate. The latch can be moved into a retracted position by turning the door handle which permits the door to be opened. In many locks, the latch is biased by a spring into the extended position.

Mortise locks also often include a deadbolt to secure the closed and latched door against attempts to force the door open. Typically, a deadbolt is extended and retracted by the rotational movement of a lock cylinder in the lock body. When the lock cylinder is rotated, the deadbolt moves between a retracted position in which the deadbolt is within the lock body, and an extended position in which the deadbolt protrudes from the lock body and into an opening of the strike plate. Because the deadbolt is typically constructed using strong, durable materials, it provides better resistance to attempts to open the door by force than a typical door latch.

The need to secure a door against forcible attempts to open it takes on enhanced importance in some applications. For example, in detention-type applications, in which possibly violent and/or dangerous persons must be detained behind a swinging door, the strength of a deadbolt to resist force becomes paramount. Other applications include residential doors in high-crime areas, designated "safe rooms" in schools, houses, or other buildings, and various applications related to military, law enforcement, and correctional facilities.

Standards organizations—such as ASTM International—have developed test methods and standards for classifying the strength of bolt designs. (Throughout this application, the term "bolt" is used to refer generically to both deadbolts and latches). These include standards for detention and correctional facilities. For example, STM Standard F1577 relates to standard test methods for detention locks for swinging doors. Among these standard tests is an impact test designed to evaluate the capability of a detention lock to resist repeated impact forces.

The need for high-strength bolt assemblies has been typically addressed by using higher strength materials for the deadbolt, latch, and/or other impact bearing components. Other approaches use larger sized components, such as a larger deadbolt or latch, to increase the strength of the lock. These approaches have been generally unsuccessful. It has become apparent that the overall size of a door lock intended to be handled by humans imparts a practical limit on how strong a conventional deadbolt or latch can be. There is a limit on the size that a deadbolt or latch can be for use in such a door, such that even use of the strongest material is not sufficient to withstand impacts that may be applied to the door. These traditional approaches to higher strength locks are not known to conform to known standards for detention and correctional facilities.

Accordingly, there is a need in the art for a lock design with improved resistance to forceful impacts. What is needed is a lock design that conforms to known standards for high-strength deadbolt assemblies. What is further needed is for such a design to be usable with typical mortise lock arrangements for swinging doors. What is further needed is for such a design to be simple and inexpensive to manufacture and install.

SUMMARY OF THE INVENTION

It is an object of the present invention to provide a lock that will have improved resistance to forceful impacts.

It is an additional object of the present invention to provide a lock that conforms to known standards for high-strength lock assemblies.

It is an object of the present invention to provide a deadbolt and latch for use with traditional mortise lock arrangements.

It is a further object of the present invention to provide such a deadbolt, latch, and lock that is relatively simple and inexpensive to manufacture and install.

These and other objects are at least partially achieved by provision of embodiments of the present invention. Embodiments of the invention permit the bolt and the tailpiece to pivot relative to one another about an axis that is substantially parallel to the plane of the door and substantially perpendicular to the axis along which the bolt moves as it is extended and retracted.

According to a first embodiment, a bolt assembly for securing a door is provided. The assembly comprises a bolt, comprising a movement axis along which the bolt travels when the bolt is extended and retracted; a tailpiece; and a pin, comprising a longitudinal axis. The pin connects the bolt and the tailpiece such that the longitudinal axis is substantially parallel to the plane of the door and is substantially perpendicular to the movement axis and such that the bolt and tailpiece are permitted to pivot with respect to each other about the longitudinal axis.

In some embodiments, the bolt is a deadbolt. In some embodiments, the tailpiece and pin are integral. In some embodiments, the deadbolt comprises a cylindrical hole to receive the pin. In some embodiments, the deadbolt comprises a slot formed in the portion of the deadbolt through which the cylindrical hole passes, and the slot is positioned in a plane that is substantially perpendicular to a central axis of the cylindrical hole. In some embodiments, the pin comprises a notch positioned to correspond to the slot when the pin is disposed in the cylindrical hole, and the assembly further comprises a clip securable to the notch for hindering removal of the pin from the cylindrical hole. In some embodiments, the tailpiece comprises a curved surface adjacent to the pin.

In some embodiments, the bolt is a latch. In some embodiments, the latch comprises a cavity at least partially shaped as a sphere adapted to receive an end of the tailpiece comprising a curved surface.

According to a second embodiment of the present invention, a lock assembly for securing a door is provided, comprising a body, adapted for installation in a mortise; a bolt, comprising a movement axis along which the bolt travels when the bolt is extended and retracted and a hole formed along an axis that is substantially perpendicular to the movement axis; and a tailpiece, disposed in the body and adapted to impart lateral movement along the movement axis to the bolt; a pin disposed in the body and comprising a longitudinal axis. The pin connects the bolt and the tailpiece such that the longitudinal axis is substantially parallel to the plane of the door and is substantially perpendicular to the movement axis and such that the bolt and tailpiece are permitted to pivot with respect to each other about the longitudinal axis.

In some embodiments, the pin and hole are substantially cylindrical. In some embodiments, the tailpiece comprises a curved surface adjacent to the pin. In some embodiments, the bolt is a deadbolt. In some embodiments, the bolt comprises a slot formed in the portion of the bolt through which the hole passes, and the slot is positioned in a plane that is substantially perpendicular to a central axis of the hole. In some embodiments, the pin comprises a notch positioned to correspond to the slot when the pin is disposed in the hole, and the assembly further comprises a clip securable to the notch for hindering removal of the pin from the hole. In some embodiments, the bolt is a latch.

According to a third embodiment of the present invention, a lock assembly for securing a door is provided. The lock assembly comprises: a body, adapted for installation in a mortise; a deadbolt, at least partly disposed in the body and movable along a first movement axis; a first tailpiece, disposed in the body and adapted to translate the rotational movement of a lock cylinder into lateral movement of the deadbolt along the first movement axis; and a first pin, comprising a first longitudinal axis and being disposed in the body such that the first longitudinal axis is substantially parallel to the plane of the door and substantially perpendicular to the first movement axis. The assembly further comprises: a latch, at least partly disposed in the body and movable along a second movement axis; a second tailpiece, disposed in the body and adapted to translate the rotational movement of a follower into lateral movement of the latch along the second movement axis; and a second pin, comprising a second longitudinal axis and being disposed in the body such that the second longitudinal axis is substantially parallel to the plane of the door and substantially perpendicular to the second movement axis. The first pin connects the deadbolt and first tailpiece so as to permit the deadbolt and first tailpiece to pivot with respect to each other about the first longitudinal axis, and the second pin connects the latch and second tailpiece so as to permit the latch and second tailpiece to pivot with respect to each other about the second longitudinal axis.

In some embodiments, the first tailpiece and first pin are integral. In some embodiments, the deadbolt comprises a cylindrical hole to receive the first pin. In some embodiments, the deadbolt comprises a slot formed in the portion of the deadbolt through which the cylindrical hole passes, and the slot is positioned in a plane that is substantially perpendicular to a central axis of the cylindrical hole. In some embodiments, the first pin comprises a notch positioned to correspond to the slot when the first pin is disposed in the cylindrical hole, and the assembly further comprises a clip securable to the notch for hindering removal of the first pin from the cylindrical hole. In some embodiments, the first tailpiece comprises a curved surface adjacent to the first pin to accommodate pivoting of the first tailpiece within the body. In some embodiments, the latch comprises a cavity at least partially shaped as a sphere adapted to receive an end of the tailpiece comprising a curved surface.

Exemplary embodiment(s) of the invention will now be described in greater detail in connection with the following drawings.

DETAILED DESCRIPTION OF THE INVENTION

Figure 1A:
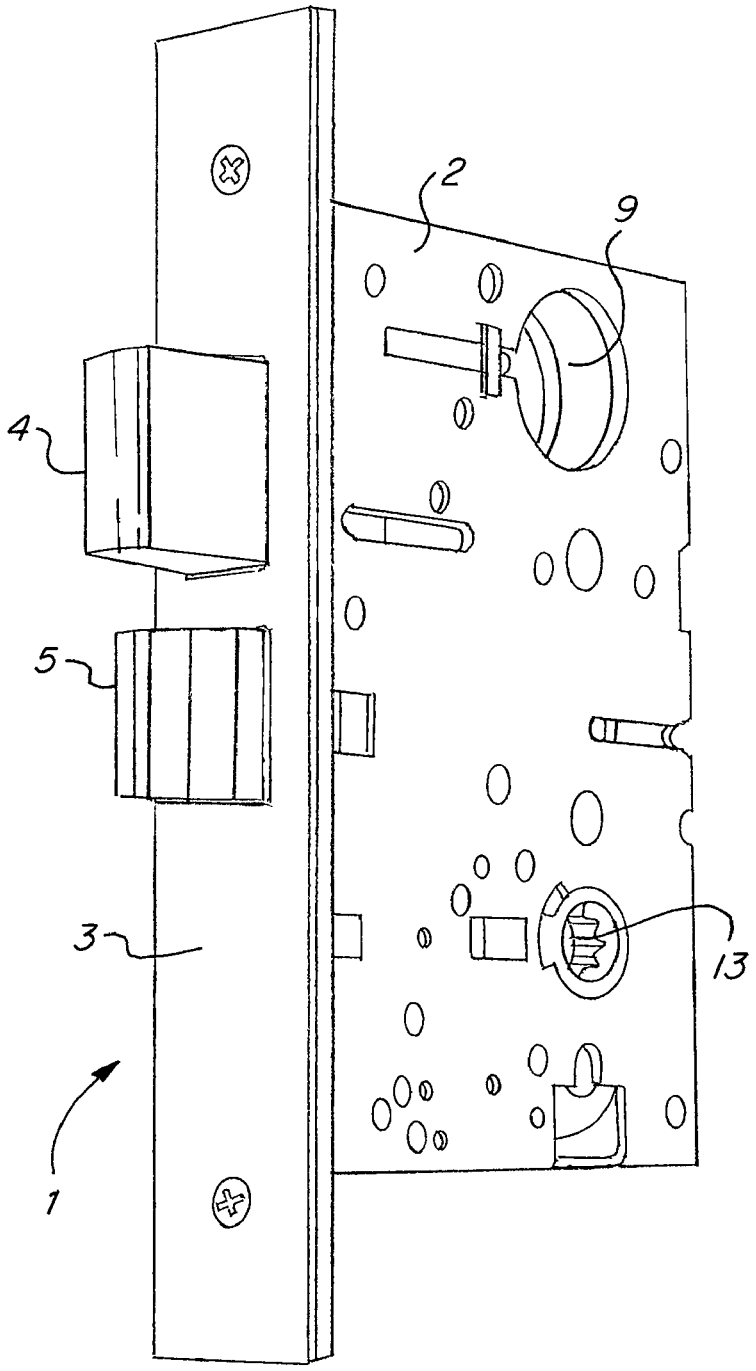
FIG. 1*a* is a perspective view of a mortise lock assembly according to a first embodiment of the present invention.

Embodiments of the invention will now be described with reference to the drawings. FIG. 1*a* shows a mortise lock assembly 1. In the embodiment shown, the assembly 1 is designed for installation in a mortise (or pocket) formed in a door. Mortises are most often formed using a mortise jig or other appropriate device. The assembly 1 comprises a lock body 2, which serves as a kind of housing for the majority of the components of the assembly 1. Sometimes, the lock body is referred to as a lock case. A faceplate 3 is secured to the lock body 2. The faceplate 3 closes the side of the lock body 2 that is accessible from the side of the door and the faceplate 3 is the portion of the assembly 1 that is visible on the side of the door.

Figure 1B:
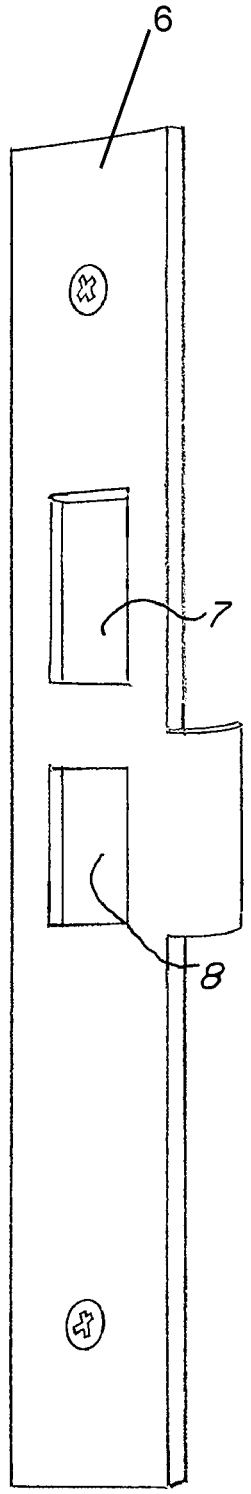
FIG. 1*b* is a perspective view of a strike plate for use with the assembly of FIG. 1.

The faceplate 3 has openings for the deadbolt 4 and a latch 5. The deadbolt 4 is shown in its extended position in FIG. 1*a*, in which, if the assembly 1 were installed in a door, the deadbolt 4 would protrude through an opening in the strike plate to lock the door. FIG. 1*b* shows an exemplary strike plate 6. The strike plate 6 is typically installed on the inside surface of the doorframe. The strike plate 6 has an opening 7 for receiving the deadbolt 4 and an opening 8 for receiving the latch 5. Although not shown in the figures, corresponding holes are cut in the doorframe to accommodate the deadbolt 4 and latch 5 when the door is closed and locked.

The lock body 2 also includes a circular opening or cylinder port 9 for accommodating a lock cylinder (not shown). As is known in the art, the lock cylinder interacts with the deadbolt 4 to move it between the extended position shown in FIG. 1*a* and a retracted position. Typically, the deadbolt lock cylinder requires use of a key on at least one side of the door to turn the lock. (In many embodiments, both sides of the lock cylinder require use of a key to turn the lock cylinder).

The lock body 2 also includes a follower hole 13, which is adapted to accommodate a spindle (not shown). The spindle connects a follower (shown in FIGS. 2*a* and 2*b*) to a door handle (not shown). When the door handle is turned, the spindle rotates the follower, which imparts lateral movement to the latch 5. The latch 5 can be moved between an extended position (as shown in FIG. 1*a*) and a retracted position.

Figure 2A:
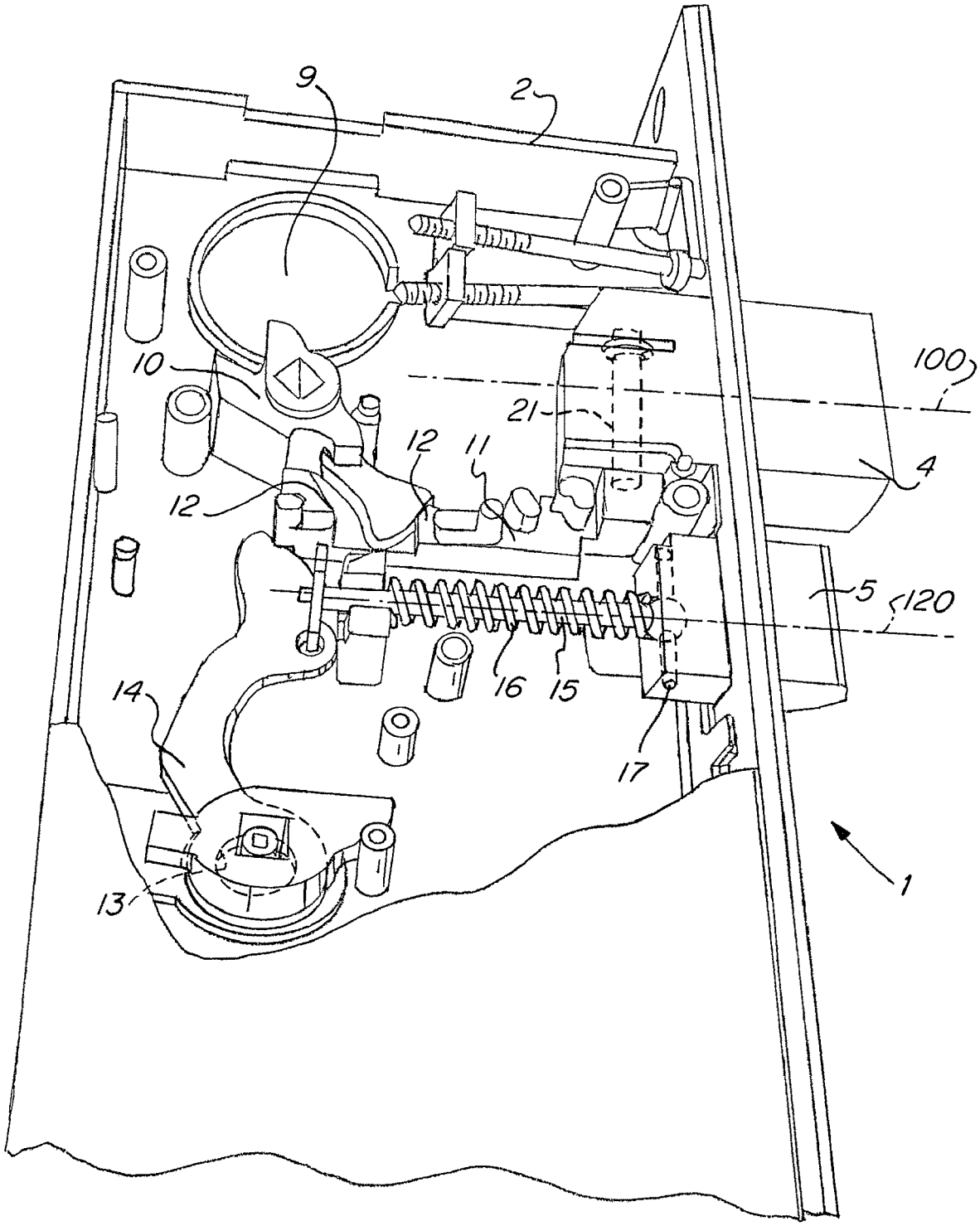
FIG. 2*a* is a perspective view of the assembly of FIG. 1*a*.

FIG. 2*a* is a view of the assembly 1 showing the inside of the lock body 2. A deadbolt cam 10 is mounted adjacent to the cylinder port 9. The deadbolt cam 10 interacts with the lock cylinder (not shown) to impart the rotational movement of the cylinder to the deadbolt 4. The deadbolt 4 is connected to a tailpiece 11. The tailpiece 11 has protrusions 12 against which the cam 10 bears to impart the movement of the turning lock cylinder.

The follower 14 interacts with a spindle (not shown) to impart the rotational movement the spindle to the latch 5. The latch 5 has a tailpiece 15 attached to it and that is acted upon by the follower 14. In some embodiments, a spring 16 is included around the tailpiece 15 of the latch 5 to bias the latch in an extended position.

Figure 2B:
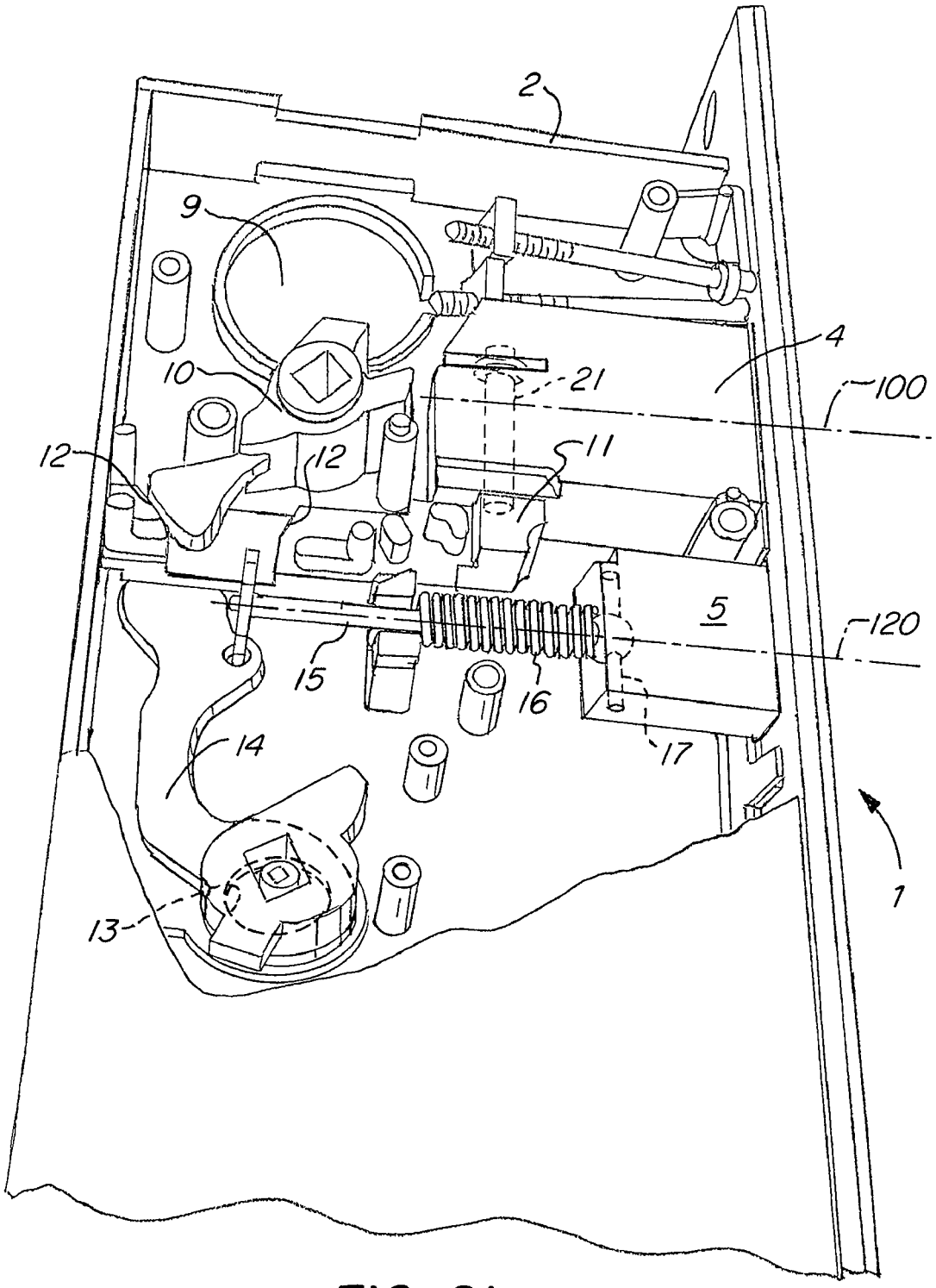
FIG. 2*b* is a perspective view of the assembly of FIG. 1*b*.

FIG. 2*a* shows the deadbolt 4 and latch 5 in their extended positions. FIG. 2*b* shows the interior of assembly 1 when the deadbolt 4 and latch 5 have been moved into their retracted positions. As shown, the cam 10 has moved the tailpiece 11, and accordingly, the deadbolt 4 to the left in the figure. The deadbolt is moved along a movement axis 100 (shown in FIGS. 2*a* and 2*b*) by the movement of the lock and the cam. The axis 100 is in the plane of the door in which the mortise lock 1 is installed. Likewise, the follower 14 has moved the tailpiece 15 and the latch 5 to the left in the figure. The latch moves along a movement axis 120. In their retracted positions, the deadbolt 4 and latch 5 are almost entirely within the lock body 2 such that, were the mortise lock installed in a door, the door could be freely opened and closed.

In prior art mortise lock assemblies, the deadbolt and its tailpiece and the latch and its tailpiece are fixed with respect to one another. In some instances, the bolt and tailpiece are integral, having been formed using a metal casting, forging, or milling process. In other instances, the bolt and tailpiece are formed separately and then fixedly joined by welding or using permanent fasteners. As described above, such prior art assemblies have proven to have a limited resistance to brute force attempts to break the lock. In many such prior art assemblies, when the bolt is in the extended position in order to secure and/or lock a door, an application of force can cause the rigidly connected bolt and tailpiece to break. In many cases, the assembly will fracture at a point of the tailpiece near to where the tailpiece meets the bolt. In many assemblies, this area is the weakest point once the bolt is extended between the door and the door frame in the extended position. Once the bolt assembly has been fractured, the door will either swing open or minor further manipulation will cause the bolt to fail completely.

According to the present invention, however, the bolt and tailpiece are joined to each other in a pivotable relationship. As shown in FIGS. 2*a* and 2*b*, the deadbolt 4 and the tailpiece 11 are joined via a pin 21 and the latch 5 and tailpiece 15 are joined by a pin 17. In this arrangement, the deadbolt is permitted to pivot relative to the tailpiece when subjected to a forceful impact. The deflection caused by such an impact will cause the deadbolt to pivot relative to the tailpiece instead of the tailpiece fracturing and the lock failing.

In the embodiment shown in FIGS. 2*a* and 2*b*, both the deadbolt assembly and the latch assembly are pivotable. In other embodiments, however, a lock assembly is provided in which the deadbolt assembly is pivotable while the latch assembly is not. In still other embodiments, the latch assembly is pivotable while the deadbolt assembly is not.

Figure 3:
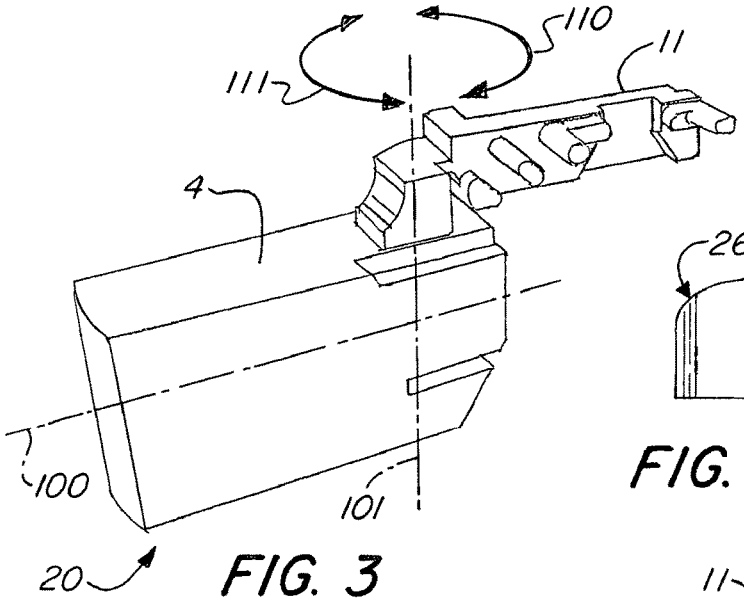
FIG. 3 is a perspective view of a deadbolt assembly for use with the assembly of FIG. 1.
Figure 4B:
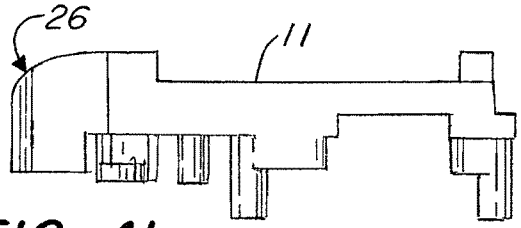
FIG. 4*b* is a top view of the tailpiece of FIG. 3.
Figure 4A:
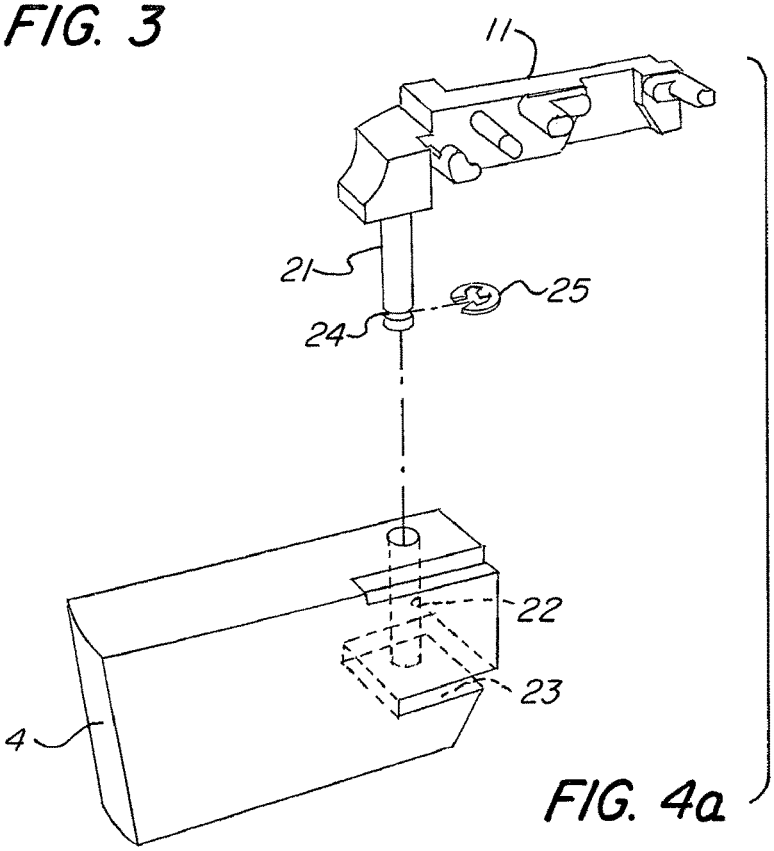
FIG. 4*a* is an exploded view of the deadbolt assembly of FIG. 3.

FIGS. 3, 4*a*, and 4*b* show additional details of a deadbolt assembly 20 according to a first embodiment of the present invention. The tailpiece 11 includes a pin 21, which, in the embodiment shown, is in the form of a cylindrical rod. In this embodiment, the pin 21 is integral with the rest of the tailpiece 11. The tailpiece 11 is formed by any suitable metal forming process, including casting, forging, etc. The deadbolt 4 includes a hole 22 adapted to receive the pin 21. In the embodiment shown, the hole is cylindrical in shape.

The pin 21, in this embodiment, includes a notch 24 that is adapted to receive a clip 25. The clip 25 is used to retain the pin 21 in the hole 22 formed in the deadbolt 4. To accommodate the clip 25, the deadbolt 4 has a slot 23. Once the tailpiece 11 has been attached to the deadbolt 4 by insertion of the pin 21 into the hole 22, the clip 25 is snapped into place on the notch 24. The clip 25 fits within the slot 23 and prevents the pin 21 from being removed from the hole 22. In the embodiment shown, the slot 23 is formed generally in a plane that is substantially perpendicular to the central axis of the cylindrical hole 22.

Once the deadbolt assembly 20 assembled, the deadbolt 4 and the tailpiece 11 are able to pivot relative to one another about the longitudinal axis of the pin 21. This axis is shown in FIG. 3 as axis 101. When the assembly 20 is installed in the mortise lock assembly 1 in a door, the axis 101 is generally parallel to the plane of the door, but is generally perpendicular to the movement axis 100 of the deadbolt 4 along which the deadbolt 4 moves between the extended and retracted positions. The deadbolt 4 and tailpiece 11, therefore, pivot relative to one another in the directions indicated by arrows 110 and 111.

In the embodiments shown, both the pin and the corresponding hole are generally cylindrical to permit rotation of the parts joined by the pin and hole. In other embodiments, however, the hole and/or pin have different shapes. The shapes can be any that permit pivoting of the tailpiece relative to the deadbolt.

The tailpiece 11 shown in FIG. 4*b* includes a curved portion 26. In this embodiment, the curved portion 26 is located near the pin 21, which is integral with the tailpiece 11. In this embodiment, the hole 22 in the deadbolt 4 is offset from the center of the deadbolt (as defined, for example, by the movement axis 100). Because of this, one side of the tailpiece 11 is closer to the side of the deadbolt than the other side when the two components are connected. The curved surface 26 is formed on the tailpiece 11 to provide additional clearance for the tailpiece to rotate relative to the deadbolt within the lock body in which the assembly is installed. In the embodiment shown in FIGS. 3, 4*a*, and 4*b*, the curved surface 26 is formed on the side of the tailpiece 11 that is closest to the side of the deadbolt as a result of the off-center hole 22. In other embodiments, the tailpiece 11 includes curved surfaces on both sides to better accommodate pivoting of the tailpiece. In still other embodiments, the deadbolt 4 includes one or more curved surfaces to provide additional rotation or pivoting clearance. In other embodiments, both the deadbolt and the tailpiece include such curved surfaces.

Figure 5A:
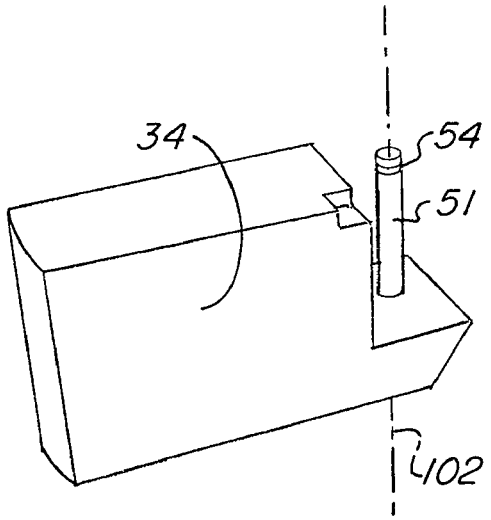
FIG. 5*a* is a perspective view of a deadbolt according to a second embodiment of the present invention.
Figure 5B:
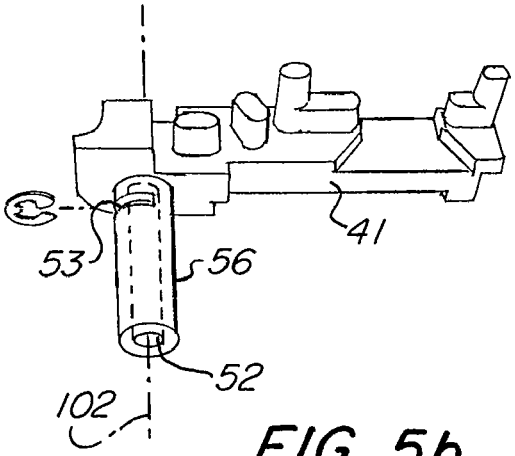
FIG. 5*b* is a perspective view of a tailpiece according to the second embodiment of the present invention.

FIGS. 5*a* and 5*b* show a second embodiment of a deadbolt assembly according to the present invention. In this embodiment, the deadbolt 34 has a pin 51, and these components are integral with each other. Accordingly, the tailpiece 41 shown in FIG. 5*b* has a cylindrical portion 56 with a hole 52 sized to receive the pin 51. The cylindrical portion 56 includes a slot 53 to accommodate a clip. Accordingly, the pin 51 has a notch 54 to receiving the retaining clip similar to the first embodiment described above. As in the embodiment of FIGS. 3, 4*a*, and 4*b*, the deadbolt assembly shown in FIGS. 5*a* and 5*b*, when assembled, permits the deadbolt 34 and the tailpiece 41 to rotate with respect to one another about the axis 102. Axis 102 is shown in both FIGS. 5*a* and 5*b* for reference. As in other embodiments described herein, the axis 102 is oriented substantially parallel to the plane of the door and substantially perpendicular to the movement axis of the deadbolt when the deadbolt assembly is installed in a mortise lock assembly that is installed in a door.

Figure 6A:
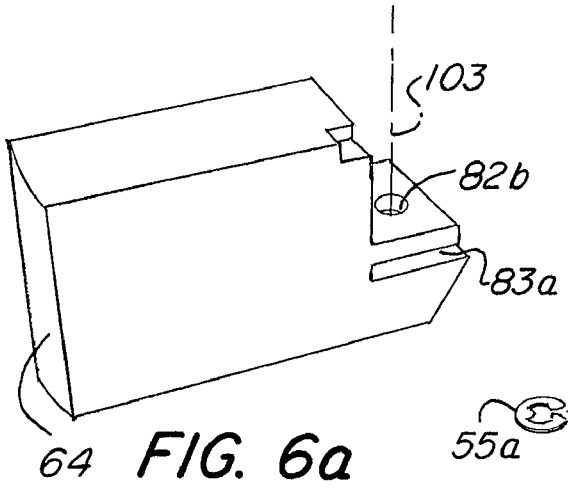
FIG. 6*a* is a perspective view of a deadbolt according to a third embodiment of the present invention.
Figure 6C:
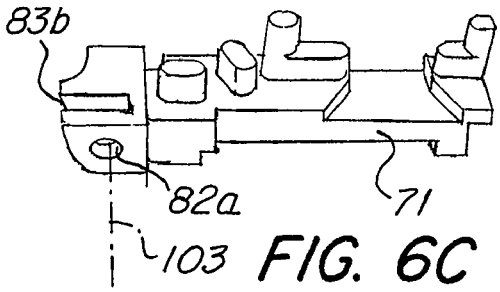
FIG. 6*c* is a perspective view of a tailpiece according to the third embodiment of the present invention.
Figure 6B:
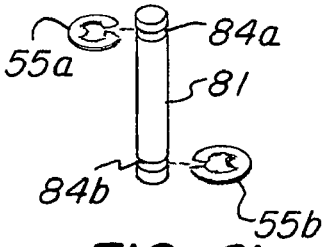
FIG. 6*b* is a perspective view of a pin according to the third embodiment of the present invention.

FIGS. 6*a*, 6*b*, and 6*c* show a third embodiment of a deadbolt assembly according to the present invention. In this embodiment, both the deadbolt 64 and the tailpiece 71 have holes 82*a* and 82*b* for receiving a pin 81. The pin 81 is, in this embodiment, a separate component from both the deadbolt 64 and the tailpiece 71. In order for this embodiment to function reliably, two retaining clips 55*a* and 55*b* are required. The pin 81 has two notches 84*a* and 84*b* for receiving the retaining clips. The deadbolt 64 has a slot 83*a* for accommodating one of the clips and the tailpiece 71 has a slot 83*b* for accommodating the other of the clips. The slots 83 and clips 84 cooperate to hold the components of the deadbolt assembly shown in FIGS. 6*a*, 6*b*, and 6*c* together. As in the previously described embodiments, the deadbolt 64 and tailpiece 71 will, when assembled pivot relative to one another about the axis 103. When the deadbolt assembly is installed in a mortise lock assembly and installed in a door, the axis 103 is oriented substantially parallel to the plane of the door and substantially perpendicular to the axis along which the deadbolt moves when moving between an extended position and a retracted position.

The deadbolt assemblies of FIGS. 3-6*c* are adapted for use with a lock assembly such as the one shown in FIGS. 1-2*b*. In some embodiments, the deadbolt assemblies are sold included with a complete lock assembly for installation in a door. In other embodiments, the deadbolt assemblies are provided separately from a lock assembly (as an aftermarket upgrade, for example) and can be installed in a lock assembly that is compatible with the deadbolt assembly.

Figure 7:
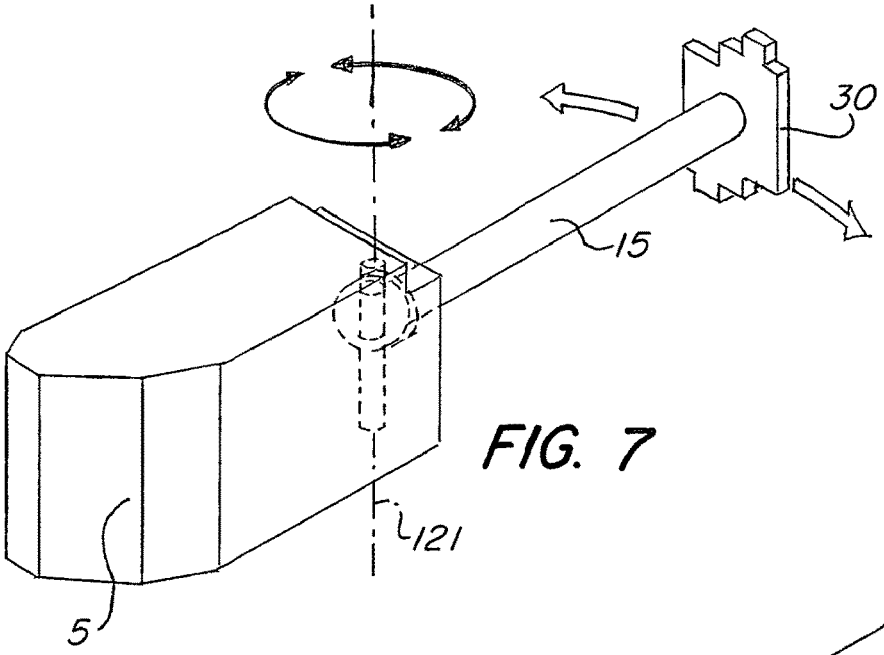
FIG. 7 is a perspective view of a latch for use with the assembly of FIG. 1.

FIG. 7 shows an exemplary embodiment of a pivotable latch assembly according to the present invention. The latch 5 is connected to the tailpiece 15 such that the latch and tailpiece can pivot relative to one another. They pivot about the axis 121, which is positioned generally within the plane of the door in which the lock in which the latch assembly is installed. The axis 121 is also substantially perpendicular to the movement axis 120 along which the latch 5 moves when it is extended and retracted. The latch assembly also includes an endpiece 30 that is connected to the second end of the tailpiece 15, and which interacts directly with the follower component of the lock assembly.

Figure 8:
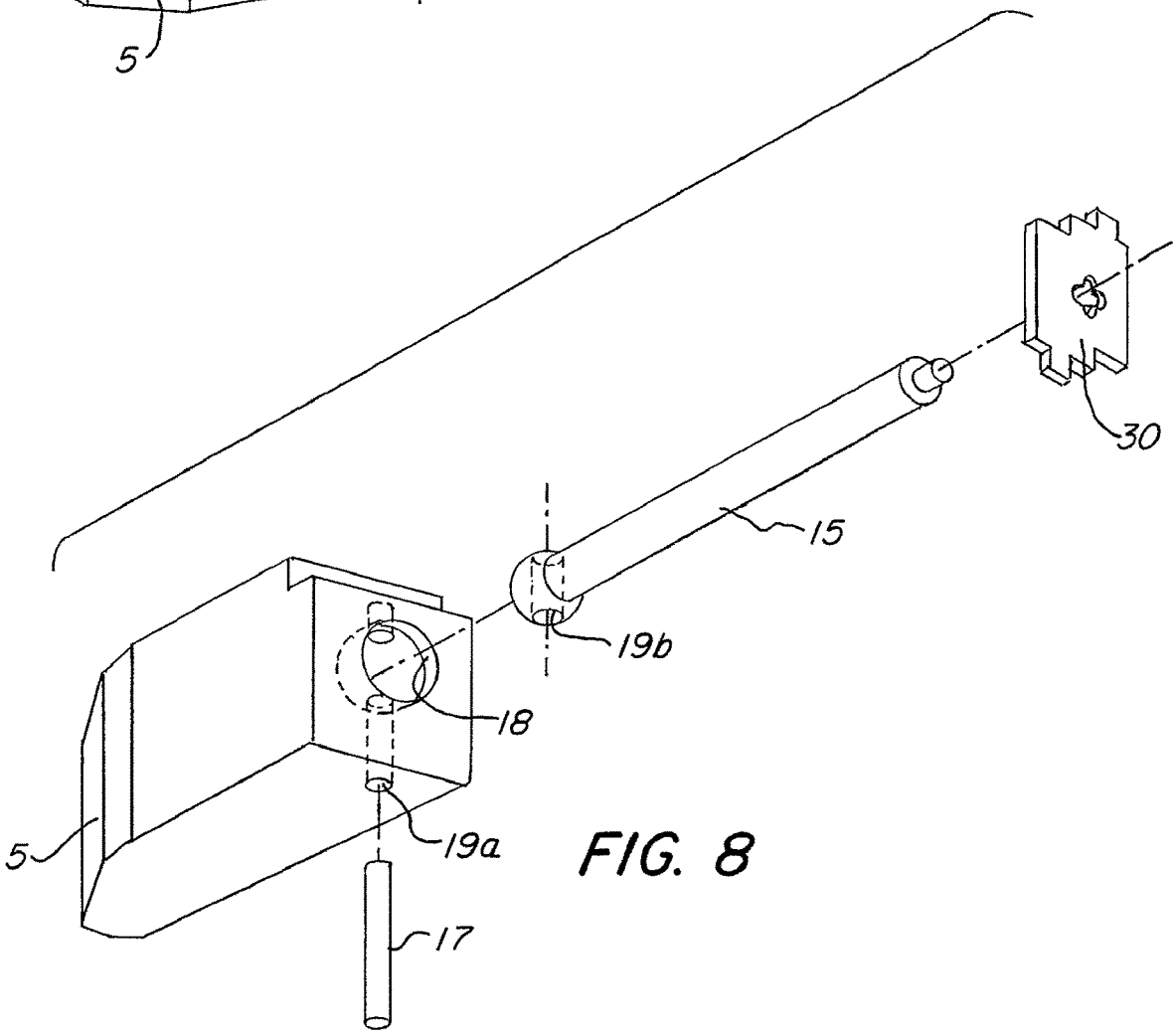
FIG. 8 is an exploded view of the latch of FIG. 7.

FIG. 8 shows an exploded view of the latch assembly of FIG. 7. The latch 5 has a cavity 18, which is adapted to receive an end of the tailpiece 15. The cavity 18 has the shape of at least part of a sphere, as does the end of the tailpiece 15. In other embodiments, the cavity 18 and curved end of the tailpiece 15 have shapes other than that of a sphere, such as, for example, a cylindrical shape. The latch 5 and the tailpiece 15 both have holes 19*a* and 19*b*, respectively, for receiving the pin 17. As in the embodiments of the deadbolt assembly discussed above, the pin 17 is retained in the holes 19*a* and 19*b*.

The pivotable nature of the bolt assemblies according to embodiments of the present invention enable locks in which the assemblies are installed to better absorb impacts intended to force the door open. Instead of fracturing at a point roughly between the tailpiece and bolt, the tailpiece and bolt will pivot relative to one another. The pivoting permits the bolt and tailpiece to "flex" in response to a forceful impact, and remain in a secure, locked condition throughout the impact.

Although the invention has been described with reference to particular embodiments and arrangements of parts, features and the like, these are not intended to exhaust all possible embodiments, arrangements, or features, and indeed many other modifications and variations will be ascertainable to those of skill in the art.

What is claimed is:

1. An assembly for securing a door, comprising:

a deadbolt, comprising a deadbolt movement axis along which the deadbolt travels when the deadbolt is extended to a locked position and retracted to an unlocked position, the deadbolt movement axis extending from the unlocked position to the locked position;

a deadbolt tailpiece;

a deadbolt pin, comprising a longitudinal axis;

wherein the deadbolt pin connects the deadbolt and the deadbolt tailpiece such that the longitudinal axis of the deadbolt pin is substantially parallel to the plane of the door and is substantially perpendicular to the movement axis of the deadbolt, the deadbolt moves from the unlocked position to the locked position along the deadbolt movement axis, and the deadbolt and deadbolt tailpiece are permitted to pivot with respect to each other about the longitudinal axis of the deadbolt pin while the deadbolt remains in the locked position in response to an external impact on the door;

a latch, comprising a latch movement axis along which the latch travels when the latch is extended and retracted;

a latch tailpiece;

a latch pin, comprising a longitudinal axis; and wherein the latch pin connects the latch and the latch tailpiece such that the longitudinal axis of the latch pin is substantially parallel to the plane of the door and is substantially perpendicular to the movement axis of the latch and such that the latch and latch tailpiece are permitted to pivot with respect to each other about the longitudinal axis of the latch pin.

2. The assembly of claim 1, wherein the deadbolt tailpiece and deadbolt pin are integral.

3. The assembly of claim 2, wherein the deadbolt comprises a cylindrical hole to receive the deadbolt pin.

4. The assembly of claim 3, wherein the deadbolt comprises a slot formed in a portion of the deadbolt through which the cylindrical hole passes, and wherein the slot is positioned in a plane that is substantially perpendicular to a central axis of the cylindrical hole.

5. The assembly of claim 4, wherein the deadbolt pin comprises a notch positioned to correspond to the slot when the deadbolt pin is disposed in the cylindrical hole, and wherein the assembly further comprises a clip securable to the notch for hindering removal of the deadbolt pin from the cylindrical hole.

6. The assembly of claim 5, wherein the deadbolt tailpiece comprises a curved surface adjacent to the deadbolt pin.

7. The assembly of claim 1, wherein the latch comprises a cavity at least partially shaped as a sphere adapted to receive an end of the latch tailpiece comprising a curved surface.

8. A lock assembly for securing a door, comprising:

a body, adapted for installation in a mortise;

a deadbolt, comprising a deadbolt movement axis along which the deadbolt travels when the deadbolt is extended to a locked position and retracted to an unlocked position, the deadbolt movement axis extending from the unlocked position to the locked position, and a hole formed along an axis that is substantially perpendicular to the deadbolt movement axis;

a deadbolt tailpiece, disposed in the body and adapted to impart lateral movement to the deadbolt from the unlocked position to the locked position along the deadbolt movement axis;

a deadbolt pin disposed in the body and comprising a longitudinal axis;

wherein the deadbolt pin connects the deadbolt and the deadbolt tailpiece such that the longitudinal axis of the deadbolt pin is substantially parallel to the plane of the door and is substantially perpendicular to the deadbolt movement axis, the deadbolt moves from the unlocked position to the locked position along the deadbolt movement axis, and the deadbolt and deadbolt tailpiece are permitted to pivot with respect to each other about the longitudinal axis of the deadbolt pin while the deadbolt remains in the locked position in response to an external impact on the door;

a latch, comprising a latch movement axis along which the latch travels when the latch is extended and retracted;

a latch tailpiece, disposed in the body and adapted to impart lateral movement along the latch movement axis to the latch;

a latch pin disposed in the body and comprising a longitudinal axis; and wherein the latch pin connects the latch and the latch tailpiece such that the longitudinal axis of the latch pin is substantially parallel to the plane of the door and is substantially perpendicular to the latch movement axis and such that the latch and latch tailpiece are permitted to pivot with respect to each other about the longitudinal axis of the latch pin.

9. The assembly of claim 8, wherein the deadbolt pin and hole in the deadbolt are substantially cylindrical.

10. The assembly of claim 9, wherein the deadbolt tailpiece comprises a curved surface adjacent to the deadbolt pin.

11. The assembly of claim 8, wherein the deadbolt comprises a slot formed in a portion of the deadbolt through which the hole passes, and wherein the slot is positioned in a plane that is substantially perpendicular to a central axis of the hole.

12. The assembly of claim 11, wherein the deadbolt pin comprises a notch positioned to correspond to the slot when the deadbolt pin is disposed in the hole, and wherein the assembly further comprises a clip securable to the notch for hindering removal of the deadbolt pin from the hole.

13. A lock assembly for securing a door, comprising:

a body, adapted for installation in a mortise;

a deadbolt, at least partly disposed in the body and movable from an unlocked position to a locked position along a first movement axis;

a first tailpiece, disposed in the body and adapted to translate the rotational movement of a lock cylinder into lateral movement of the deadbolt from the unlocked position to the locked position along the first movement axis;

a first pin, comprising a first longitudinal axis and being disposed in the body such that the first longitudinal axis is substantially parallel to the plane of the door and substantially perpendicular to the first movement axis;

a latch, at least partly disposed in the body and movable along a second movement axis;

a second tailpiece, disposed in the body and adapted to translate the rotational movement of a follower into lateral movement of the latch along the second movement axis; and a second pin, comprising a second longitudinal axis and being disposed in the body such that the second longitudinal axis is substantially parallel to the plane of the door and substantially perpendicular to the second movement axis;

wherein the first pin connects the deadbolt and first tailpiece so as to permit the deadbolt and first tailpiece to pivot with respect to each other about the first longitudinal axis while the deadbolt remains in the locked position in response to an external impact on the door; and wherein the second pin connects the latch and second tailpiece so as to permit the latch and second tailpiece to pivot with respect to each other about the second longitudinal axis.

14. The assembly of claim 13, wherein the first tailpiece and first pin are integral.

15. The assembly of claim 14, wherein the deadbolt comprises a cylindrical hole to receive the first pin.

16. The assembly of claim 15, wherein the deadbolt comprises a slot formed in a portion of the deadbolt through which the cylindrical hole passes, and wherein the slot is positioned in a plane that is substantially perpendicular to a central axis of the cylindrical hole.

17. The assembly of claim 16, wherein the first pin comprises a notch positioned to correspond to the slot when the first pin is disposed in the cylindrical hole, and wherein the assembly further comprises a clip securable to the notch for hindering removal of the first pin from the cylindrical hole.

18. The assembly of claim 14, wherein the first tailpiece comprises a curved surface adjacent to the first pin to accommodate pivoting of the first tailpiece within the body.

19. The assembly of claim 13, wherein the latch comprises a cavity at least partially shaped as a sphere adapted to receive an end of the tailpiece comprising a curved surface.

* * * * *